United States Patent [19]

Alduk

[11] 4,050,217

[45] Sept. 27, 1977

[54] CASE PACKER CONTAINER FEEDING APPARATUS

[75] Inventor: Frank P. Alduk, New Castle, Pa.

[73] Assignee: Newcastle Company, Inc., New Castle, Pa.

[21] Appl. No.: 623,379

[22] Filed: Oct. 17, 1975

[51] Int. Cl.[2] ..... B65B 57/14; B65B 57/20

[52] U.S. Cl. ..... 53/62; 53/159

[58] Field of Search ..... 53/61, 62, 159

[56] References Cited

U.S. PATENT DOCUMENTS

| | | | |
|---|---|---|---|
| 2,679,963 | 6/1954 | Neal | 53/62 |
| 3,160,259 | 12/1964 | Dalton | 53/61 X |
| 3,593,493 | 7/1971 | Alduk | 53/159 X |
| 3,708,947 | 1/1973 | Green et al. | 53/62 X |

*Primary Examiner*—Travis S. McGehee

*Attorney, Agent, or Firm*—Parmelee, Miller, Welsh & Kratz

[57] ABSTRACT

A feeder is provided for feeding containers into the several lanes provided between divider plates above the conveyor belt of a case packer as the containers are transferred to the dump table or the like of a case packer. It delivers a predetermined number of rows of containers with a selected number of containers in each row to the belt conveyor of a case packer until a case load of containers is supplied to said belt, and upon a case load being then discharged from the case packer, the cycle is repeated to feed another case load to the case packer, the operation continuing indefinitely as long as the case packer is operating.

10 Claims, 4 Drawing Figures

CASE PACKER CONTAINER FEEDING APPARATUS

This invention is for a feeder for supplying containers to a case packer and which is especially useful for feeding non-circular bottles, and particularly odd-shaped plastic bottles now in wide use to the case packer. The invention as here shown is an attachment for a standard case packer, such as disclosed in U.S. Pat. No. 3,592,002 granted July 13, 1971; U.S. Pat. No. 3,593,493 granted July 20, 1971 and U.S. Pat. No. 3,619,967 granted Nov. 16, 1971 to me, but it could be made an integral part of newly-constructed case packing machines.

In case packers as commonly constructed, including those in my patents above referred to, the containers, generally round or polygonal containers having many sides, are discharged from a production conveyor onto the feeder belt of the case packer. Partitions extending along over the conveyor form generally parallel lanes terminating at some kind of receiving tray, typically, as in the aforementioned U.S. Pat. No. 3,593,493, onto a dump plate or table where an inverted multi-cell carton can be slipped over a group of containers in such manner that there is one container in each cell of the carton. The dump tray then flips the loaded carton over onto a receiving conveyor, as is well-understood in the art. In other case packers, the containers may drop through the tray into a multi-cell carton, or may slide endwise from a tray into the open end of an inclined case. The term "dump tray" as used herein applies to the receiving tray or table of whatever type onto which a case load of containers is arranged by the case packer for placement in a multi-cell carton.

For example, where twelve containers are to be packed in a carton, the case packer belt may direct the containers haphazardly into three lanes, and when four rows of three containers have moved from the case packer belt onto the dump tray, the four rows of three are charged into the multi-cell carton. In another instance there may be four lanes over the belt conveyor of the case packer and the case packer will feed three rows of four each onto the dump tray. In another example, four rows of six, or six rows of four will be supplied to the dump tray where a case which contains 24 cells will be filled.

These machines work almost flawlessly with circular or near circular containers, especially glass or metal containers where the containers being carried on the case packer belt will roll against one another so that as a container enters one lane it will crowd its neighbors to one side or the other toward or into the entrance of another lane.

The present trend is to market many products, including detergents, liquid washing preparations, hand lotions, shampoos and the like, and even dry powders and tablets in plastic bottles of rectangular section, or oval or flat eliptical shapes which will not roll one against another into the lanes so that one lane may be starved with a "pyramid" of containers building up in front of other lanes. When they do enter the lanes there is no assurance that they will all be uniformly positioned. Some may have the long axis of the oval lengthwise of the conveyor belt instead of all of them being uniformly crosswise or lengthwise.

The present invention provides a feeder where the containers, instead of being discharged randomly onto the conveyor belt of the case packer, are received from the production line of filling line in a single file, all having their long axes (in horizontal section) in the same direction. As they move to the case packer, a counter counts off the number of containers in a row, the line stops, a pusher shoves the row of containers into the selected lanes of the case packer, the line of containers then resumes and the operation is repeated, and when a case load, say four rows of three containers, has been pushed into the lanes of the case packer, all operations are halted until or unless the dump tray or dump table is ready to receive another case load.

The machine in its preferred embodiment therefore involves an intermittently operated feeder belt, a counter for stopping and starting the feeder when a row of containers is in position to move into the lanes of the case packer, a pusher for moving the row from said feeder belt into the lanes of the case packer, a counter for counting each stroke of the pusher and stopping the feeding when a case load has been so transferred to the case packer until the dump tray of the case packer operates, and then there is started a new cycle of operations when the next case load is required. It will often be that three or four case loads may be on the conveyor belt of the case packer so that as each case load moves onto the case packer conveyor belt, a load placed on the belt three or four cycles previously will move onto the dump tray, whereby no time is lost while a load delivered to one end of the case packer belt arrives at the dump tray end, but normally no lane will recive more containers than another and there will be two or three case loads of containers on the case packer conveyor belt after an initial start-up. At the initial start-up a manual switch can effect the feeding of several case loads to the case packer belt without reference to the operation of the dump table, until an adequate supply of containers is on the conveyor belt of the case packer.

The invention may be more fully understood by reference to the accompanying drawings illustrating somewhat schematically a preferred embodiment of the invention, and in which.

Figure 2:
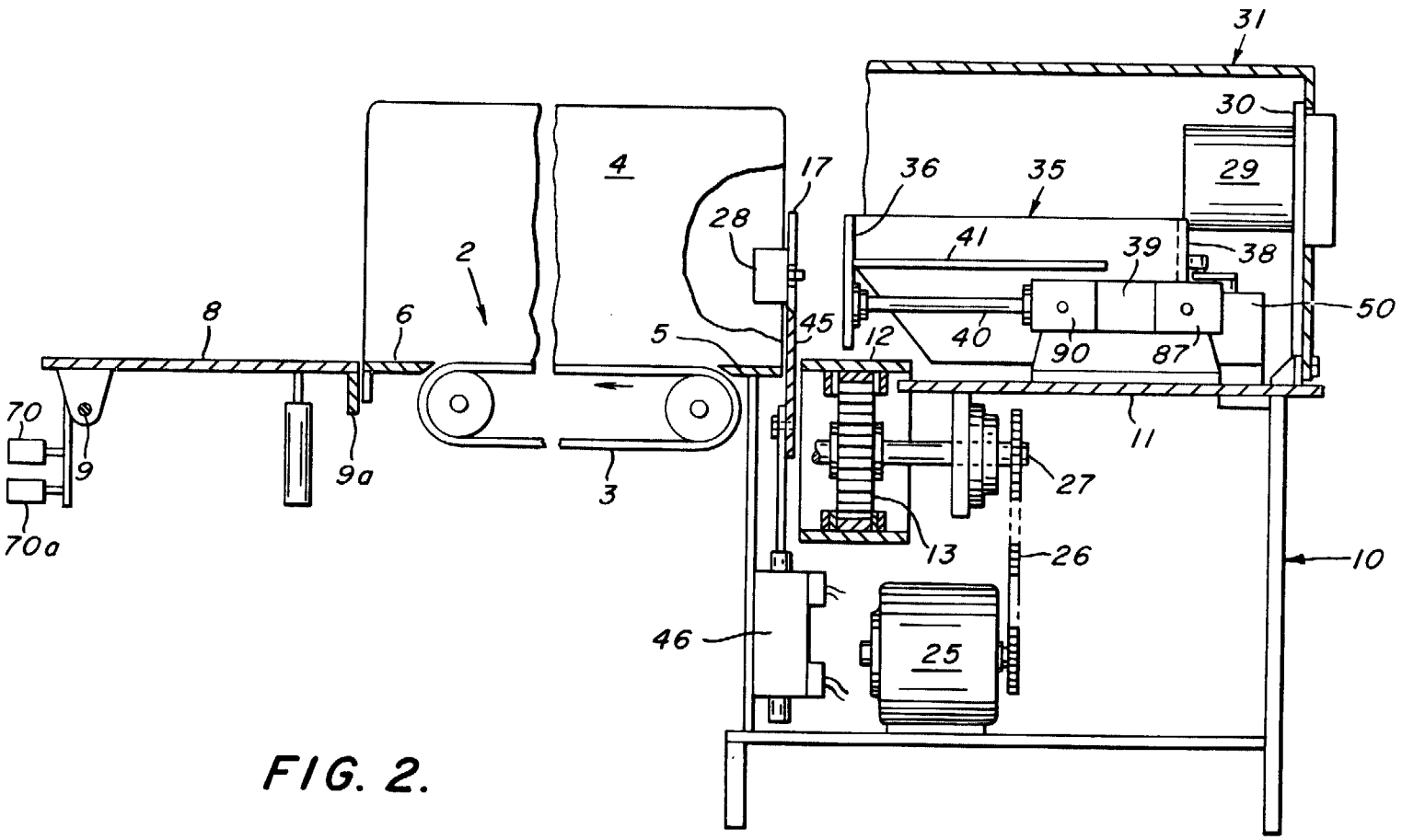
FIG. 2 is a transverse vertical section substantially in the plane of line II—II of FIG. 1, the view also showing, schematically, the case packer foreshortened to indicate the dump tray.
Figure 3:
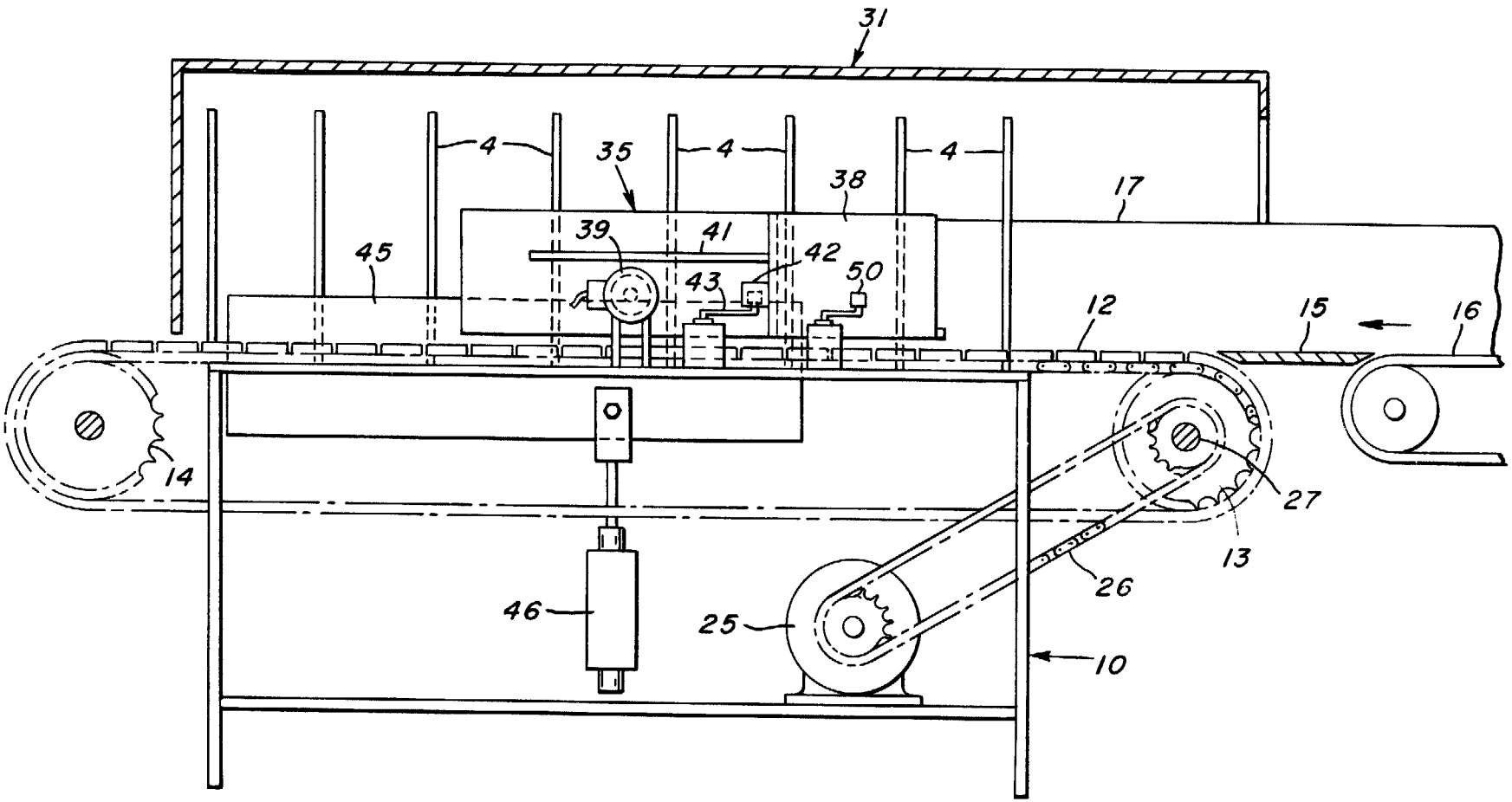
FIG. 3 is a somewhat schematic front elevation of the feeder with the enclosures partially removed and partially in vertical section and with the feeder belt moving from right to left.

Referring to the drawings, it may be explained that 2 designates generally a case packer having a conveyor belt 3 that is driven by an electric motor (not shown). There are parallel partition plates 4 extending the full length of the belt from a short apron or fixed plate 5 at the receiving end over a dead-plate 6 at the discharge end, forming parallel lanes 7 along which containers are carried by the belt and discharged onto a dump tray or table 8. This dump tray may take a number of different forms, but for purpose of illustration is here indicated to be a tray as shown in my U.S. Pat. No. 3,593,493, above referred to, which tilts about a shaft 9 (FIG. 2) as an axis and, when it tilts, a gate or barrier **9*a*** between the dead-plate and the dump tray springs up to block the travel of any containers from the several lanes until the dump tray has been swung back to a horizontal position after having been tilted, all as shown and explained in said patent.

In practice the partition plates 4 are adjustable crosswise of the case packer conveyor belt to make fewer wide lanes or more narrow lanes. For the purpose of the following description we need discuss only lanes 7A, 7B, and 7C, since, in the example here chosen for illustration, containers will be fed in successive transverse rows of three containers per row, and four rows will then provide a case load of 12.

The feeder as here shown is designed as an attachment to be secured to the receiving end of the case packer. It comprises a supporting frame 10 with a deck 11 which is about flush with the level of the upper reach of the belt 3 of the case packer. Along that side of the deck which is nearer the case packer there is the top reach of a feeder belt 12 that passes around a drive roll 13 at its left end and a supporting roll 14 at its right end. The feeder belt is therefore at right angles to the case packer belt and is located close to the receiving end of the case packer belt. Desirably, feeder belt 12 is comprised of a succession of plates pivotally linked together much like the crawler belt of a tractor so that its top reach does not sag or warp. At its left end there is a dead-plate 15 over which containers will be pushed as they leave a conveyor belt 16 (forming no part of this invention) from which the containers are transferred from a forming or filling machine to the feeder of this invention.

Figure 1:
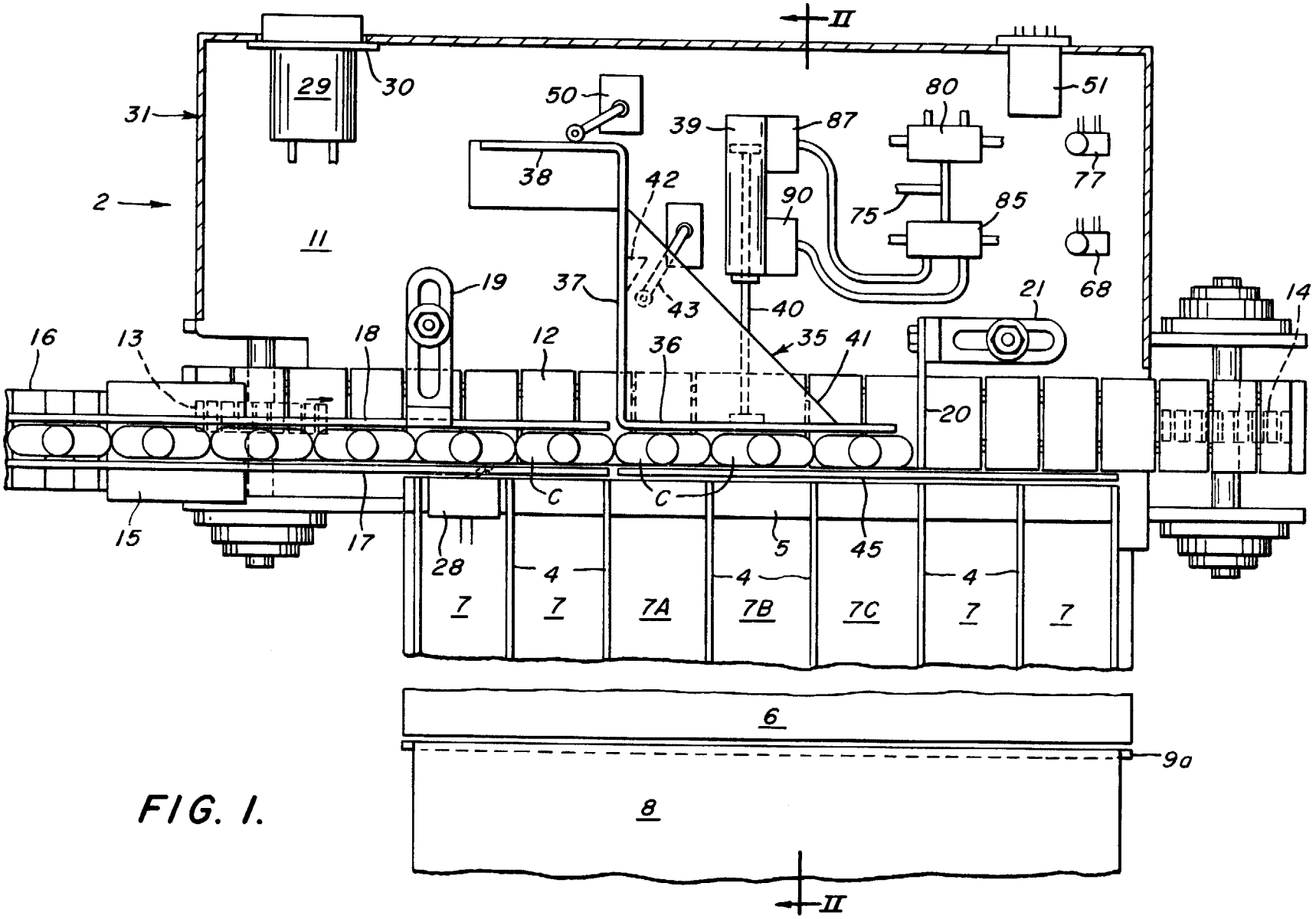
FIG. 1 is a somewhat schematic top plan view of the feeder positioned at the receiving end of the case packer conveyor belt with the cover over the mechanism in horizontal section.

There is a fixed vertical guide plate 17 extending along that side of the conveyor 12 adjacent the end of the case packer, and in this case it terminates at the partition 4 forming the left side of lane 7A as viewed in FIG. 1. Spaced from this guide plate 17 and parallel with it is a guide plate 18 adjustable across the conveyor 12 toward or away from the wall 17, leaving a space or channel between the guide plates 17 and 18 over the conveyor 12 along which the containers, C, here indicated as generally eliptical-shaped plastic bottles, are guided into position at the entrance to lanes 7A, 7B and 7C. Guide plate 18 is coextensive in length with guide 17, and 19 indicates an adjusting bracket clamped to the deck 11 for adjusting guide 18 toward or away from 17 to accommodate thicker or thinner containers.

There is a transverse stop-plate 20 adjustably clamped by bracket 21 to the deck plate 11. This plate extends across the conveyor 12 in line with that partition 4 which forms the right lane, as viewed in FIG. 1 of the last row, here row 7C of the case packer, into which containers are to be delivered.

There is an electric motor 25 mounted in the frame 10 beneath the deck 11 that drives the conveyor belt roll 13 through sprocket chain 26 and sprocket wheel 27 at the end of roll 13. On the guide plate 17 there is a switch 28 that has a contact that projects through the plate 17 so that as each container moves past this switch, herein termed a "counter switch", an electric circuit is closed to send an impulse to a counter 29 mounted on the front panel 30 of an enclosure 31 that encloses the various devices that are on the deck plate 11. This counter, which, like the counter switch, is a well-known, off-the-shelf device, can be selected to operate each time a selected number of containers has moved past the counter switch 28 to stop the motor. In the specific example here illustrated, each time three containers have moved in position with a container in front of each lane 7A, 7B, and 7C the counter will operate to stop the motor 25 and the conveyor 12.

There is a pusher, designated generally as 35, having a container-engaging plate 36, a side bar 37, and an end extension 38 arranged to be reciprocated transversely across the conveyor 12 by an air cylinder and piston unit 39 having a piston rod 40 connected to the plate 36. A gusset member 41 extends above the level of the deck 11 between pusher plate 36 and side wall 37.

When the cylinder and its piston and piston rod are in the position shown in FIG. 1, the pusher is retracted, but upon pressure air being admitted to one end of the cylinder 39, the pusher will move across the conveyor 12 from the position shown to a position where the containers in front of it will be moved as a row, here a row of three containers, into the opposite lanes 7A, 7B, and 7C. When the pusher reaches the forward limit of travel, a cam 42 on the side plate 37 of the pusher will engage the contact arm of an air valve or air switch schematically indicated at 43 to reverse the travel of the pusher, as hereinafter more fully described.

To guide the containers as they are carried beyond the end of the guide plate 17 and in front of the pusher, there is a vertically-movable barrier or stop plate 45 along the edge of the conveyor belt 12 and in front of the entrance to the several lanes 7 of the case packer. Normally its top edge extends above the level of the conveyor 12 a short distance, but its top edge is always below the counter switch 28. It is movable from this normal position to a level below the top of the conveyor 12, there being an air cylinder and pisiton unit 46 in the frame below the conveyor 12 having a piston rod attached to the plate 45 between its ends. Guides at the ends of the plate are provided, but for clarity of illustration have been omitted. This cylinder and piston unit is connected to a source of air pressure to raise the plate 45 when the pusher retracts, and lower it as or just before the pusher moves forward to move the containers into the selected lanes. This operation will hereinafter be described in more detail, but air switch 43 which effects the retraction of the pusher also effects the raising of the barrier 45.

The counter switch 28 is located upstream from, or in advance of, the pusher 35 and the vertically movable barrier so that all of the containers forming a single row to be moved by the pusher will be carried by the belt to the entrance end of the respective lanes into which they will be discharged as the counter operates to stop the feeder belt. This insures that there need be no container that will be carried with the traveling belt into pressure against an already stopped bottle, or pressure of a moving line of bottles being urged forward by the belt against one whose travel has been blocked. Since the arm of the counter bears against the side of each passing container and does not restrain its movement in any way, as would be the case where some kind of gate or star-wheel counter is used, the oncoming line of containers does not exert pressure or container rotating forces as would be the case where the belt continues to travel while a lead container has been stopped by such a gate or star wheel.

It will be seen that the lateral extension 38 on the rear end of the pusher engages an operating element of a switch 50 on the deck at the rear of this extension. When the pusher moves forward or toward its extended position, this switch will operate to reset the counter for counting the bottles in the next row when the belt again operates, and also each operation of the pusher will result in an impulse being sent to a second counter 51 to count the number of rows being pushed into the case packer, so that if a carton is to receive four rows of three containers in each row, the feeding of more containers will normally be interrupted unless the case packer has disposed of a case load, as hereinafter more fully described.

Figure 4:
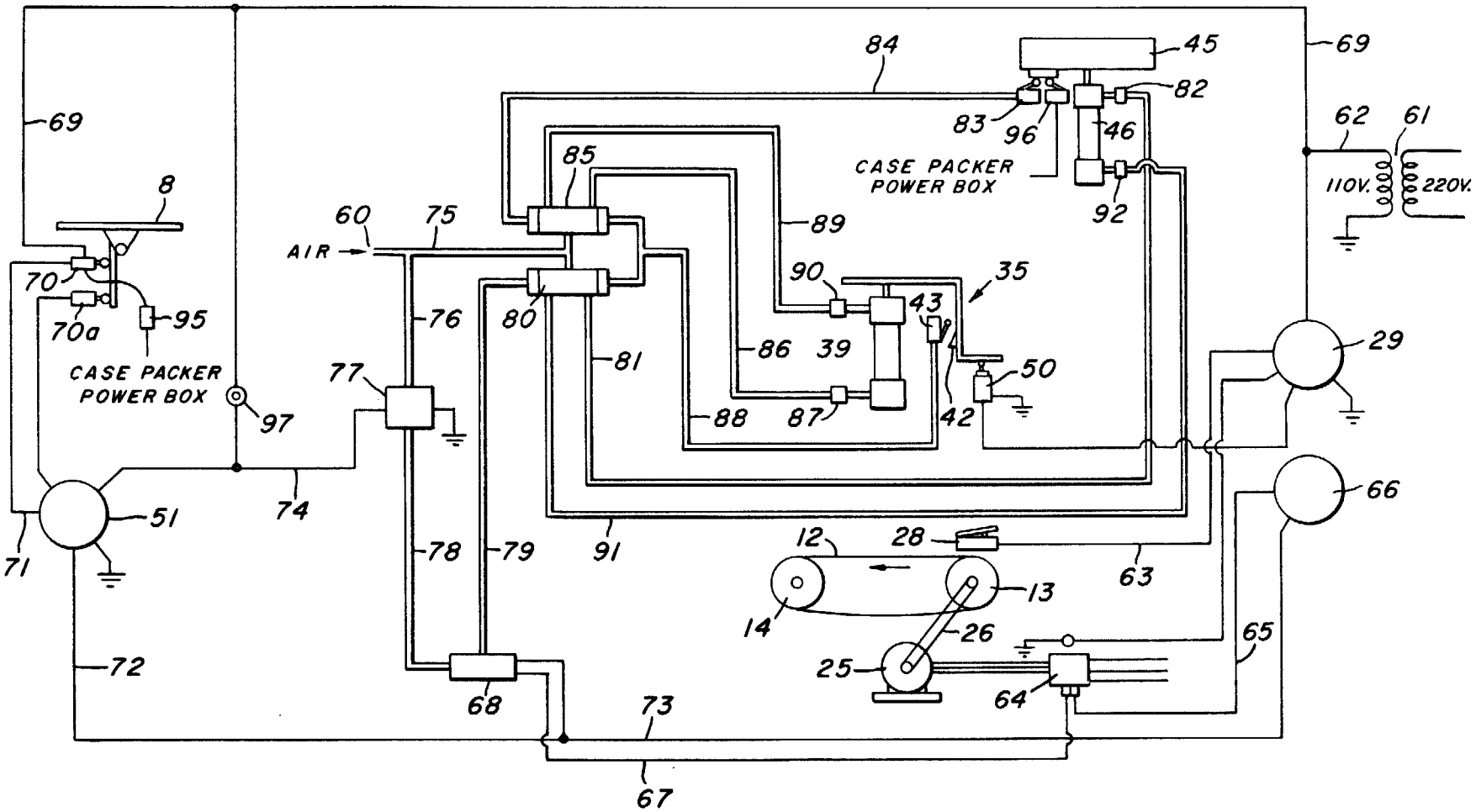
FIG. 4 is a schematic diagram of the operating circuitry where single lines indicate electric circuits and close double lines are air tubes or pipes.

While the feeder could be manually controlled entirely or partially by an attendant, it is designed for automatic operation, and FIG. 4 is a schematic diagram of an automatic system for effecting continuous unattended operation. In the diagram single lines indicate electric wiring and close double lines indicate air lines communicating with a source of pressure air (not shown) at 60.

In FIG. 4 there is indicated a step-down transformer 61 that reduces line voltage at 220 to a lower control circuit voltage, typically about 110 volts. One side of the secondary transformer leads to line 62 terminating at the container counter 29 which has been heretofore described. A line 63 leads from counter 29 to the container counting switch 28 so that each time the switch 28 operates the counter will be operated. The counter is conveniently adjustable to count to any selected number of units within a short range, and in the operation here assumed, it will operate to three units, and then reset. Thus, when the transformer 61 is energized, current will initially flow through the counter and line 63 to close motor control relay 64 to operate motor 25 and the feed belt 12, feeding containers past the counter 28. When the selected number of containers, as here assumed to be three, have passed the switch 28 the counter 2 will open relay 64 and stop the travel of the feeder belt 12.

When relay 64 is deenergized to stop the motor, it closes one side of a circuit through line 65 to a timer 66, and through line 67 to one side of a solenoid-operated air valve 68. The other side of the solenoid valve circuit comprises line 69 leading also from line 62 to a remotely-positioned switch 70 associated with the dump tray of the case packer in such manner that the switch is closed when the dump tray is in container-receiving position, but opens when the dump tray is discharging a case load of containers. From switch 70 the solenoid circuit continues through line 71, row counter 51 and line 72 to wire 73, one terminal of which leads to the solenoid valve 68 and the other terminal of which leads to timer 66. If, when the first side of solenoid valve 68 is closed by the operation of relay 64 to energize the motor 25, the dump tray of the case packer is discharging, switch 70 to line 69 will be open and nothing will happen. If switch 70 is closed, then it will energize the row counter 51 to start counting the rows for the next case load. At the same time the counter 51 will energize the motor (not shown) that drives the case packer conveyor belt (as contrasted with the feeder belt 12). A companion switch **70*a*** also energizes the bottle rows counter circuit when rows counter has first been reset and keeps it energized until the dump tray next discharges its load.

The pipe or tube 75 connected at 60 with a source of air under pressure has a branch pipe 76 that leads through a solenoid valve 77 and pipe 78 to solenoid valve 68, these two solenoid valves thus being in series to supply air through pipe or tube 79 leading to a four-way valve 80.

The four-way valve has one outlet port 80 connected through pipe 81 and flow control valve 82 to the upper end of cylinder 46 that operates the stop plate 45 in front of the several lanes of the case packer, so that if both solenoid valves 68 and 77 are open this stop plate will be lowered. When the stop plate lowers it operates a vent valve 83 leading through pipe 84 to a second four-way valve 85, also connected to the air supply line 75. Thereupon air flows through pipe 86 and flow control valve 87 to the rear end of cylinder 39 to drive the pusher 35 forward to push the row of containers on the belt 12 into the lanes 7A, 7B, and 7C, the stop plate 45 then being out of the path of the containers. When the pusher reaches its forward limit the cam 42 will depress air switch 43 to reduce pressure through line 88 and to cause the reversal of both of the four-way valves 80 and 85 so that pressure air then flows through line 89 and flow control valve 90 to the forward or rod end of cylinder 39 to retract the pusher. At the same time air flows from four-way valve 80 through line 91 and flow control valve 92 to the lower end of cylinder 46 to raise the stop plate 45 into its elevated position.

When the pusher 35 moves forward, switch 50 at the rear of the pusher operates to counter 29 in its cycle. This cycle, to recapitulate, starts with the belt 12 moving a selected number of containers, in the example here explained, three containers. With the passage of three containers, whch are now positioned at the front of three lanes, 7A, 7B and 7C over the case packer conveyor belt, the counter 29 stops motor 25 that drives the belt 12. With the dump tray of the case packer in position to receive a case load of containers the air valves 68 and 70 pas air to cylinder 80 to first lower stop plate 45. When the stop plate is down, air switch 83 is operated to move the pusher 35 to transfer the row of three containers to the case packer, one container in each of three lanes of the case packer. When the pusher has reached its forward limit, air switch 43 operates to reverse the travel of the pusher and raise the stop plate 45. Each operation of the pusher is effected through a circuit that includes a row counter, and when a number of rows sufficient to constitute a case load, in this example four, have been delivered to the case packer conveyor, the row counter will stop all operations unless the case packer dump tray operates to discharge a case load of containers from the case packer, which, by operation of switch **70*a* responding to the return of the dump tray to container-receiving position, resets the row counter for a new cycle. The timer 66 allows a short time interval to elapse after the motor is de-energized and before the pusher can operate to assure that the feeder belt 12 will have come completely to rest and adequate time for a cycle to be completed after motor 25** is deenergized before the next cycle can start.

It has been previously mentioned that the conveyor belt of the case packer will normally be driven only when the dump tray is in bottle or container-receiving position. This is controlled by a switch 95 forming a normal part of the case packer and located where it will open to stop the conveyor belt of the packer when the dump tray is operating to discharge a case load and remain open until the dump tray is restored to bottle-receiving position. Also there is a switch 96 under the stop plate 45 to cause the operation of the case packer conveyor belt any time the plate 45 is lowered for the pusher to feed a row of containers onto the case packer conveyor belt.

There are times, such as start-up time, when the case packer belt may have no containers on it or an insufficient number for automatic recycle. A manually-operable switch, typically a pushbutton switch 97 conveniently located on the case packer which, when closed, connects line 69 with line 74, will over-ride the row counter 51 and switches 70 and 70a so that row feeding of containers can take place without interruption as long as the switch 97 is manually held closed.

Spacing collars (not shown) are placed around the piston rod 40 to limit the retracting movement of the pusher 35 to a position where its front plate 36 will be in line with bottle guide 18 so that while bottles are moving to position in front of the pusher and at the entrance to the lanes 7A, 7B and 7C they will be guided between the front of the pusher and the vertically-movable stop plate.

In some instances the case packer will load only one shape and size of containers day after day, in which case the various adjustments herein provided are unnecessary, but in most instances, the case packer will run for a period of time on one product in one size of container, and then to other products, in succession in other sizes or styles of containers the various adjustments are required. It should perhaps be noted that switch 50 at the rear of pusher extension 38 must be adjusted as the travel of the pusher is increased or decreased by the placing of spacers on the pusher operating rod 40 as above described.

There is an apron or transfer 5 at the entrance to each lane of the case packer over which a row of bottles will move onto the case packer conveyor belt. If the last row of bottles in a case load from the feeder remains on this plate, it will not matter since the first row of the next case load from the feeder will push them off and several case loads are normally carried on the case load feeder belt.

While I have sometimes herein referred to bottles and elsewhere to containers, the invention is, of course, applicable to the feeding of bottles specifically and other containers generally, such as lighter fluid and household oil containers, etc., so that the term "bottles" and "containers" as herein used are interchangeable, applying to any of the units that are generally or may be case-packed on case-packing machines.

I claim:

1. For use with a case packer having a belt conveyor of a length sufficient to accommodate more than a single case load lot of containers thereon at one time with a receiving end and at discharge end and a plurality of spaced paralell partitions extending thereover from end-to-end providing a plurality of parallel lanes along which containers travel from one end of the conveyor to the other, there being a dump tray at the discharge end of the conveyor onto which the containers are collected in single case lots with the containers arranged in longitudinal and transverse rows, the dump tray being operable to discharge each case load before the next one starts to accumulate thereon, the case packer feeder being operable for depositing containers of either circular horizontal section or of elliptical or oval horizontal section on the case conveyor feeder belt of the successive rows and parallel lanes for assembly on the dump plate of the case packer in case lots of uniform pattern, said case packer comprising:

a. an intermittently operating feeder conveyor arranged to move a row of containers into position at the receiving end of the case packer with one container in front of each of said lanes, b. counter means arranged to be actuated by containers on the feeder conveyor to stop said feeder conveyor when a row of containers has been carried by the feeder conveyor into position where one container of the row is aligned with one of the lanes of the case packer, c. a pusher arranged to push the containers in each such row into the respective lanes of the case packer in front of which the containers are positioned during the time the feeder conveyor is stationary, and then retract, said counter means having a counter switch located along the feeder conveyor in advance of the pusher and arranged to be activated by each container on the feeder conveyor as it is carried by the belt past the switch, and d. switch means positioned to be operated by the dump tray of the case packer arranged to stop the case packer feeder belt when the dump tray is operating to discharge a case load of cartons therefrom and restore operation of the feeder conveyor when the dump tray is in position to receive containers from the case packer belt conveyor.

2. The case packer feeder in claim 1 wherein there is a manually operable shunt switch for overriding said last named switch means for enabling the machine operator to selectively accumulate more than a single case load of containers on the case loader conveyor without interruption by operation of the dump tray.

3. For use with a case packer having a belt conveyor with a receiving end and a discharge end and a plurality of spaced parallel partitions extending thereover from end-to-end providing a plurality of parallel lanes along which containers travel from one end of the conveyor to the other, there being a dump tray at the discharge end of the conveyor onto which the containers are collected in successive case lots with the containers arranged in longitudinal and transverse rows, the dump tray being operable to discharge each case load before the next one starts to accumulate thereon, the case packer feeder comprising:

a. an intermittently operating feeder conveyor arranged to move a row of containers into position at the receiving end of the case packer with one container in front of each of said lanes, b. counter means arranged to be actuated by containers on the feeder conveyor to stop said feeder conveyor when one container is so positioned in front of each row, c. a pusher arranged to push the containers in each such row into the respective lanes of the case packer in front of which the containers are positioned during the time the feeder conveyor is stationary, and then retract, d. other means arranged to correlate the operation of the feeder conveyor to the operation of the case packer to stop the feeder conveyor after each case load of containers has been delivered to the belt conveyor of the case packer until a case load of containers has been discharged from the packer, and e. the feeder conveyor being an endless conveyor belt extending transversely across the receiving end of the case packer conveyor belt with guides along the feeder belt arranged to keep containers of noncircular horizontal section from rotating about their vertical axes and to keep them aligned in single file until a row of containers is in position at the front of the respective lanes of the case packer conveyor.

4. The case packer feeder defined in claim 3 wherein one of said guides comprises a vertically movable gate at a level to contact the confronting said walls of containers positioned on the feeder conveyor located opposite the pusher between the feeder conveyor and the receiving end of the case packer conveyor to prevent premature entry of containers from the feeder conveyor into the case packer, and there is means for moving said gate vertically out of position where it blocks entry of the containers into the respective lanes when the feeder conveyor is stationary and just before the pusher operates.

5. The case packer feeder defined in claim 4 in which there is a fluid pressure cylinder and piston unit raising and lowering said gate and means operable upon the stopping of the feeder belt for effecting the operation of said cylinder and piston unit for moving the gate out of position where it blocks entry of the containers into said lanes.

6. The case packer feeder defined in claim 5 wherein the pusher comprises an element movable from a retracted to an extended position for simultaneously contacting all of the containers positioned in a row in front of the entrance end of the packer conveyor and a second fluid pressure cylinder and piston unit for operating said element, there being means controlled by the movement of said gate out of lane-blocking position to effect the operation of said pusher to its extended position for pushing the containers from the feeder conveyor into the several lanes.

7. The case packer feeder defined in claim 6 wherein means is provided for effecting the retraction of said pusher when it has been extended and also effecting the return of said gate to a position where it again blocks the entrance of containers into said lanes.

8. A case packer feeder as defined in claim 1 wherein there is a driving motor for operating the feeder conveyor belt and there is an impulse responsive counter means for stopping the motor each time a row of containers on the feeder belt is in position where each container on the belt comprising the row is at the entrance of the case packer lane into which it is to be pushed and the counter means also comprises a counter switch positioned along the feeder belt arranged to transmit an impulse to the impulse responsive counter each time a container is carried past said counter switch.

9. A case packer feeder as defined in claim 8 wherein there is a second counter for counting each operation of the pusher and arranged to energize said driving motor to effect a repetition of the container-moving, counting and pushing cycle, and means controlled by the operation of the dump table of the case packer for rendering said second counter inoperative after a case load of containers has been fed by the feeder into the entrance end of the packer conveyor unless and until the dump tray operates to discharge a case load from the case packer.

10. For use with a case packer having a plurality of parallel lanes over an endless conveyor so arranged and of a length to receive and transport more than two case load lots of containers at one time and that moves containers through the lanes from a receiving end onto a dump table at the discharge end, the dump table being arranged to receive successive transverse rows of containers and retain them in longitudinal alignment with said lanes until a predetermined case lot has been assembled on the dump table, means for effecting a dumping operation of the dump table when a case lot has been received on it, the invention comprising a case packer feeder comprising:

a. a feeder conveyor extending transversely across the receiving end of the case packer conveyor, b. means for intermittently operating the feeder conveyor in increments arranged to present a row with one container in the row in front of each lane on the case packer and then stop the feeder conveyor, c. pusher means arranged to push the containers in front of the case packer lanes into the respective lanes when the feeder conveyor stops, d. means to actuate the feeder conveyor when the pusher retracts, and e. means to prevent the feeding and pushing cycle from repeating after a predetermined number of such cycles until the dump table of the case packer operates to discharge a case load of containers and return to a position to again receive containers from the case packer conveyor.

* * * * *